US005806426A

United States Patent [19]

Choulet

[11] Patent Number: 5,806,426

[45] Date of Patent: Sep. 15, 1998

[54] PRINTING METHOD, A MACHINE FOR IMPLEMENTING THE METHOD, AND MEDIUM THUS PRINTED

[75] Inventor: Luc Choulet, Montreuil, France

[73] Assignee: L'Oreal, Paris, France

[21] Appl. No.: 810,917

[22] Filed: Mar. 5, 1997

[30] Foreign Application Priority Data

Mar. 8, 1996 [FR] France ..... 96 02948
Jul. 30, 1996 [FR] France ..... 96 09563

[51] Int. Cl.[6] ..... B41M 1/14

[52] U.S. Cl. ..... 101/211; 101/174; 101/492

[58] Field of Search ..... 101/211, 492, 101/135, 174; 400/124.09; 395/101, 131, 132, 109; 358/2, 61, 520, 534, 536, 298, 529, 202; 347/43, 115, 232; 355/88

[56] References Cited

U.S. PATENT DOCUMENTS

| | | | |
|---|---|---|---|
| 3,420,170 | 1/1969 | Smith . | |
| 3,426,679 | 2/1969 | Rhines . | |
| 3,752,072 | 8/1973 | Lorber | 101/401.1 |
| 4,081,828 | 3/1978 | Jones et al. | 101/135 |
| 4,446,470 | 5/1984 | Sugiyama et al. | 347/100 |
| 4,580,150 | 4/1986 | Tazaki | 400/279 |
| 4,852,485 | 8/1989 | Brunner | 101/211 |
| 4,953,015 | 8/1990 | Hayasaki et al. | 358/529 |
| 5,010,814 | 4/1991 | Shishikura | 101/211 |
| 5,123,343 | 6/1992 | Willer . | |
| 5,463,471 | 10/1995 | Chou | 358/298 |
| 5,485,180 | 1/1996 | Askeland et al. | 358/298 |
| 5,535,673 | 7/1996 | Bocuo et al. | 101/492 |
| 5,537,228 | 7/1996 | Dillinger | 358/502 |
| 5,550,569 | 8/1996 | Wright | 347/43 |
| 5,570,118 | 10/1996 | Rezanka et al. | 347/43 |
| 5,631,748 | 5/1997 | Harrington | 395/109 |
| 5,657,137 | 8/1997 | Perumal, Jr. | 358/502 |
| 5,671,340 | 9/1997 | Chapman et al. | 395/101 |

FOREIGN PATENT DOCUMENTS

| | | |
|---|---|---|
| A-36 28 198 | 2/1988 | Germany . |
| C-97 054 | 2/1961 | Netherlands . |
| C-97 056 | 2/1961 | Netherlands . |
| A-1 197 056 | 7/1970 | United Kingdom . |

*Primary Examiner*—Eugene H. Eickholt
*Attorney, Agent, or Firm*—Oliff & Berridge, PLC

[57] ABSTRACT

A method of printing a color image on a medium, the method comprising the following steps:

separating the image to be reproduced into a composition of colored unit areas, said unit areas being disposed in a predetermined distribution, the color of each unit area being selected from a predetermined set of base colors and a predetermined set of tones of said base colors, the number of tones for at least one of the base colors being greater than or equal to three, the base color and the tone allocated to each of said unit areas being selected so that said composition of colored unit areas visually reconstitutes the image to be reproduced; and printing said composition of colored unit areas on said medium by means of inks whose hues are selected, taking into account the color of said support, so as to be capable of reproducing said base colors and the tones thereof during printing, the tone of a base color allocated to a given unit area being obtained during printing by acting on the proportion of each ink within the corresponding unit area on the medium.

35 Claims, 18 Drawing Sheets

Ink of color A

Ink of color B

Ink of color C

Ink of color D

STATE OF THE ART

Ink of color A

Ink of color B

Ink of color C

Ink of color D

Ink of color E

Ink of color F

Pattern

PRINTING METHOD, A MACHINE FOR IMPLEMENTING THE METHOD, AND MEDIUM THUS PRINTED

The present invention relates to a method of color printing, and more particularly, but not exclusively, to a method and to a machine for dry offset printing.

BACKGROUND OF THE INVENTION

In order to print the outside surface of a circularly cylindrical object such as a beverage can, an aerosol can, or a flexible tube, it is known that a dry offset printing method can be used comprising steps that consist in depositing inks of various colors on a blanket, and then transferring the inks onto the object by bringing it into contact with the blanket.

In practice, a plurality of blankets are used, all mounted on a rotary cylinder and inked in succession with different inks.

The inks are deposited on each blanket by means of respective applicator rollers having portions in relief formed on printing plates by photoengraving from a negative.

Various methods can be used for making such negatives.

One known method consists in separating the color original that is to be reproduced into a superposition of half-tone one-color images, with variations in the density of each one-color image being rendered by varying the sizes of the dots of the half-tone image, which method is known as amplitude modulation.

A corresponding negative is made for each half-tone one-color image.

The screen orientations of the various half-tone one-color images are inclined relative to one another so as to reduce the moiré phenomenon on printing.

Such a method does not give entire satisfaction, in particular because it does not make it possible to avoid superposing dots of ink on the blankets and the resulting mutual pollution of the inks whenever the image to be reproduced has close-together details in different colors, and such mutual pollution gives rise to the printed images being progressively degraded and requires the inks to be renewed, and can even make it necessary to discard a fraction of production.

OBJECTS AND SUMMARY OF THE INVENTION

An object of the present invention is to provide a novel method of printing which serves in particular to remedy the problem of ink pollution posed by prior art dry offset printing methods.

In more general manner, the invention also seeks to make it possible to print an image that is rich in color tones without having to create colors or color tones by mixing inks of different colors during printing.

The invention also seeks to eliminate moiré phenomena when many hues are printed.

The invention achieves this by a method of printing a color image on a medium, the method comprising the following steps:

separating the image to be reproduced into a composition of colored unit areas, said unit areas being disposed in a predetermined distribution, the color of each unit area being selected from a predetermined set of base colors and a predetermined set of tones of said base colors, the number of tones for at least one of the base colors being greater than or equal to three, the base color and the tone allocated to each of said unit areas being selected so that said composition of colored unit areas visually reconstitutes the image to be reproduced; and printing said composition of colored unit areas on said medium by means of inks whose hues are selected, taking into account the color of said support, so as to be capable of reproducing said base colors and the tones thereof during printing, the tone of a base color allocated to a given unit area being obtained during printing by acting on the proportion of each ink within the corresponding unit area on the medium.

By means of the invention, it is possible to print an image without superposing dots of ink when printing, and that has multiple advantages.

Firstly, in the special case of dry offset printing, the problem of ink pollution is greatly reduced and even eliminated.

Considerable savings can thus be achieved when printing a large number of packages.

Thereafter, the invention makes it possible to reconstitute an image visually without requiring printing inks to be mixed, and therefore without it being necessary previously to determine, either by computation or by performing trials, what colors actually result from mixing the inks which is not always easy to do, given the complexity of the mechanism whereby human beings perceive color.

The invention is thus generally applicable to all printing apparatuses and goes beyond the ambit of dry offset printing.

Whereas conventional four-color printing uses inks that are black, magenta, cyan, and yellow in color, and non-primary colors are rendered by subtractive mixing of magenta, cyan, and yellow, it is possible in the invention to use only inks that are of non-primary colors, e.g. inks whose hues are selected as a function of the subject matter of the image that is to be printed.

Thus, for example, when the image represents a face, it is preferable to select at least one ink whose hue is close to the color of the skin of the subject, thus ensuring that the visual rendition of the printed image is very close to reality.

It is also advantageous to be able, by means of the invention, to print text using a single ink without any need to generate the corresponding color by mixing printing inks.

It is also advantageous to be able to select the colors of the inks used for printing since that makes it possible to use colors that are impossible or difficult to create by subtractive synthesis of primary colors.

It will be understood that the invention is advantageously used for printing consumer objects, insofar as the visual perception of the image printed on objects displayed for sale to potential purchasers can be a determining factor.

The invention can also be used to make high-quality reproductions of paintings or photographs.

In a particular implementation of the invention, the tones of at least one base color have the same saturation but different lightnesses.

Under such circumstances, the tones of a base color that are of the same saturation but of different lightnesses can be rendered during printing by using a greater or lesser proportion of black ink within the unit areas of the medium that are concerned for obtaining said tones during printing.

In order to avoid mixing inks when using dry offset printing, when the same unit area of the medium is concerned both with a deposit of black ink and with a deposit of an ink other than black ink, then the black ink and said ink other than black ink are deposited using predetermined patterns for each of the inks, which patterns are selected to avoid the two inks being superposed.

In other printing methods in which there is no problem associated with superposing printing inks, it is possible to deposit black ink so that it is superposed over at least one other ink that has already been deposited on the medium.

In a particular implementation of the method of the invention, an ink "dot" is printed in each unit area of the medium with a shape and a size that depend in a predetermined relationship on the tone of the base color to be reproduced.

When printing is performed by bringing the medium into contact with an ink-covered surface in a displacement direction that is substantially tangential to said ink-covered surface, it is advantageous for the ink "dot" that do not fill the full extent of the associated unit areas to be of a shape that is adapted to reducing the phenomenon of accretion, and preferably to be of a shape that is tapering and substantially elongate in the displacement direction of the medium.

Thus, the accretion phenomenon which gives rise to a change in the size of a printed dot can be reduced, thereby making it possible to obtain a printed image that is closer to the original that is to be reproduced.

It has also been observed that the number of unit areas that are colored in full tends to reduce significantly when the number of tones selected for each base color increases.

Thus, the majority of the unit areas are printed in part only, and by selecting an appropriate disposition for the ink dots within said unit ares, it is possible to obtain ink dots that are disjoint, thereby making it possible to avoid the "contact" phenomenon which consists in the ink spreading in the region of contact between two touching ink dots, because of capillarity phenomena. Such an appropriate disposition of ink dots within the corresponding unit areas on the medium can consist in centering each ink dot in the associated unit area.

Also, a priori, it could be feared that the image would be impoverished by initially selecting, in accordance with the invention, a limited number of base colors into which the color original is to be separated (which original may have a far larger number of colors than the selected number of base colors), however it has been observed, surprisingly, that the visual rendition of the printed image can be better than with prior art printing methods that implement subtractive mixing of primary colors.

Firstly, the invention makes it possible for contrast differences to be greater for an observer than in the prior art because non-primary base colors have been selected.

Secondly, it is easier to obtain an impression of softness rendered by a set of high lightness hues when using colors that are non-primary than when using a mixture of primary colors as in the prior art.

In a particular implementation of the invention, at least one tone is obtained for at least one of the base colors by printing a predetermined pattern such as a logo.

Preferably, a plurality of tones of at least one of the base colors are obtained by printing a predetermined pattern such as a logo to a greater or lesser extent.

Since the pattern is difficult to counterfiet, given that it is not visible to the naked eye, this provides a means that is suitable, most advantageously, for contributing to authenticating the printed medium.

The invention also provides a printing machine including ink application surfaces respectively inked by ink dots respectively situated within unit areas disposed in a predetermined distribution so as to reconstitute visually, when printing on a medium, an image that is to be reproduced, the color of each ink dot being selected from a predetermined set of base colors, each given unit area being covered in ink to a proportion that is selected as a function of the tone to be reproduced, the number of tones being at least three for at least one of the base colors.

The invention also provides a dry offset printing machine including at least one blanket and applicator rollers carrying relief disposed in such a manner as to deposit on said blanket a set of ink dots situated respectively within unit areas disposed in a predetermined distribution so as to reconstitute visually, on printing on a medium, an image that is to be reproduced, the color of each ink dot being selected from a predetermined set of base colors, each given unit area being covered in ink to a proportion that is selected as a function of the tone to be reproduced, the number of tones being at least three for at least one of the base colors.

Preferably, each element of relief that is to deposit a dot of ink within a unit area to reproduce an intermediate tone is of a shape that is substantially slender and elongate in the displacement direction of the medium during printing so as to reduce accretion of the printed dot.

The invention also provides a print medium having an outside surface on which an image has been printed that is constituted by a set of ink dots each respectively situated within a unit area disposed in a predetermined distribution, the colors of said ink dots being selected from a predetermined set of base colors, each ink dot of a given base color filling the corresponding unit area to a greater or lesser proportion, depending on the tone of the base color to be reproduced, the number of tones being at least three for at least one of the base colors.

Preferably, at least one tone of one of the base colors is obtained on the printed medium by a predetermined pattern such as a logo, that is printed to a greater or lesser extent depending on the tone to be reproduced.

BRIEF DESCRIPTION OF THE DRAWINGS

Other characteristics and advantages of the present invention appear on reading the following detailed description of non-limiting implementations of the method of the invention, and on examining the accompanying drawings, in which.

MORE DETAILED DESCRIPTION

Figure 1:
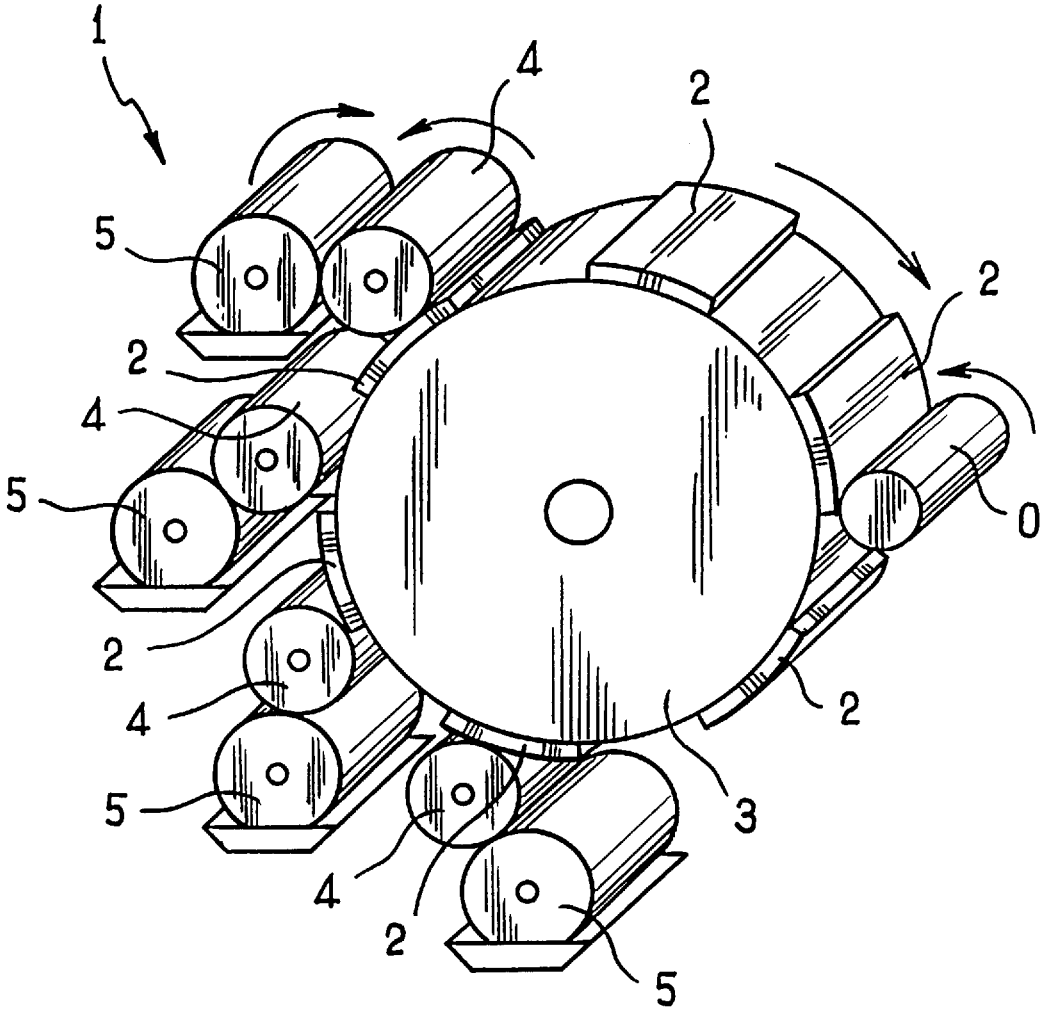
FIG. 1 is a diagrammatic perspective view of a dry offset printing machine.

FIG. 1 is a diagram showing a conventional dry offset printing machine 1 comprising a plurality of blankets 2 placed around the periphery of a rotary cylinder 3 to come successively into contact, during rotation of the cylinder, with applicator rollers 4 that serve to deposit ink dots of different colors on the blankets 2.

In the example described, only four applicator rollers 4 are shown in order to clarify the drawing, however, in practice, the machine 1 usually has six applicator rollers.

The applicator rollers 4 rotate about axes of rotation that are parallel to one another and to the axis of rotation of the cylinder 3. The outside surface of each applicator roller is constituted by a rounded plate having relief projecting radially outwards and on which ink is deposited by means of an associated lay-on roller 5 that is regularly fed with ink.

Objects 0 for receiving printing are brought by means of a carousel (not shown) so that each of them makes contact one after another with a blanket 2 ready for transferring inks.

Each object 0 rolls against the associated blanket 2 such that the different color inks deposited thereon are transferred.

Figure 2:
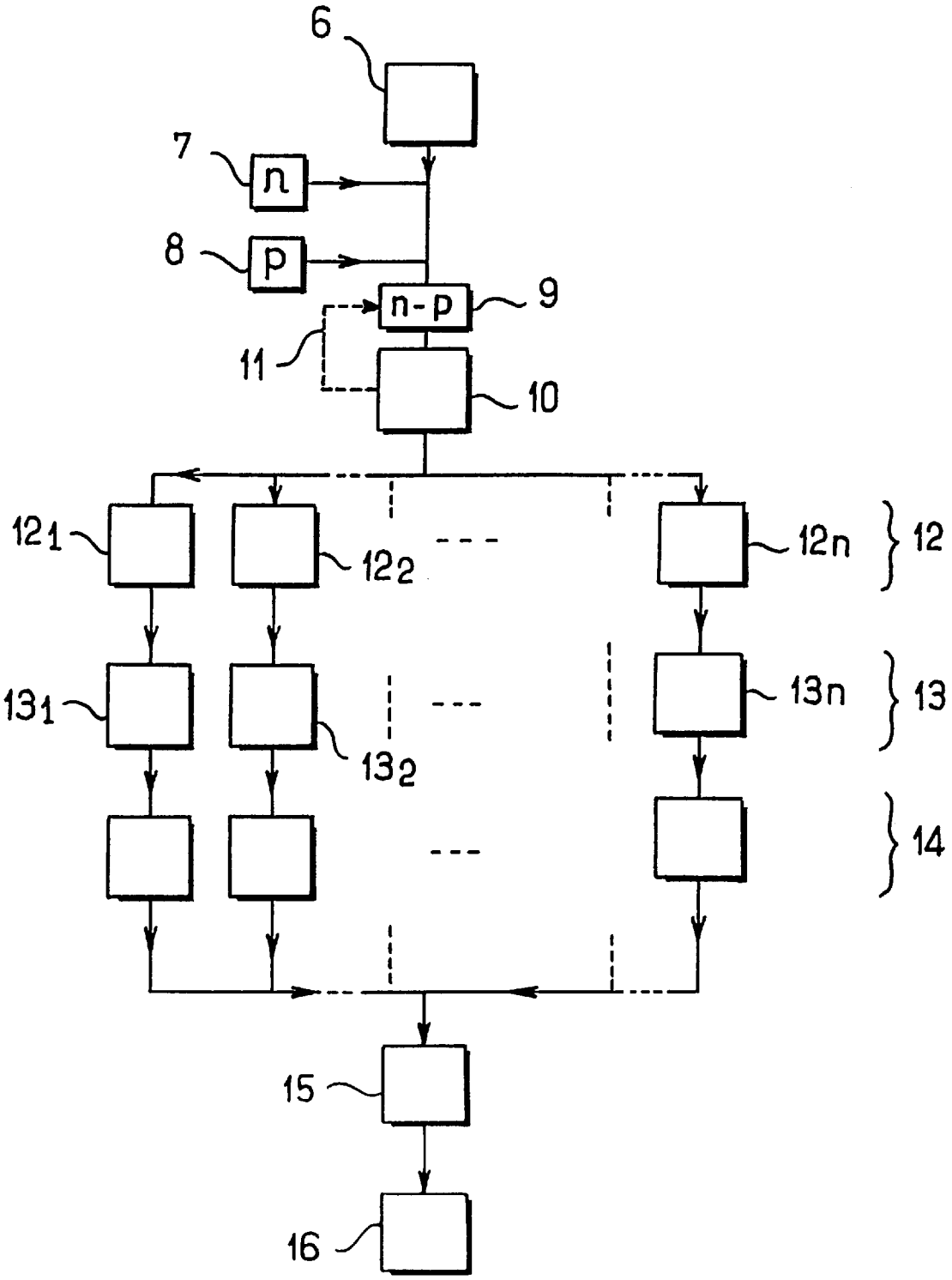
FIG. 2 is a flow chart showing the various steps of a method described to give a better understanding of the invention.

There follows a description with reference to FIG. 2 of a first example of the method, used for making negatives from which the plates of the applicator rolls are etched, and preferably implemented by means of a computer fitted with display means such as a video screen.

In the example described, the starting point is a color original 6 stored in the computer, which may either be a synthesized image or else an image stored in digital form and obtained by silver-based photography, or indeed an image provided by a video camera.

By way of non-limiting example, the original 6 may be an RGB encoded image suitable for use by version 2.5 of "Photoshop" software sold by Adobe Systems France at Noisy-le-Grand.

In a step 7 of the method, a number n of base colors is selected corresponding substantially, in the particular example described, to the various hues of ink that are to be used in the dry offset printing machine 1.

Given the number of applicator rollers normally found in this type of machine, n is usually selected to be equal to 6.

Where appropriate, in a subsequent step 8, p particular colors are forced, for example including the orange hue that is used for printing warning logos on aerosol cans, or a color selected for printing text.

This may also apply to one or more majority hues in the color original 6, e.g. a color close to the skin color of the subject, if the image is a portrait.

If the total number n of base colors in which it is desired to separate the original 6 is greater than the number of forced colors p, it is necessary either manually or automatically to select the n-p remaining colors in the next step 9 of the method, e.g. by choosing hues that are statistically in the majority in the color original 6 and that have not already been selected.

Then, in a step 10 of the method, and on the basis of the n base colors, a composition of colored unit areas is constituted and displayed on the video screen connected to the computer.

The unit areas are constituted in the example described by regularly juxtaposed squares.

The image obtained in step 10 visually reconstitutes the original 6 that is to be reproduced.

In the particular example described, the number of tones for each base color is restricted to two, i.e. each elementary area is either completely colored by a base color, or else it is not colored at all, thereby allowing the background color to show through, which is assumed in this case to be uniformly white.

If the visual rendition of the composition of unit areas is not entirely satisfactory, then the method returns to the preceding step 9 in which the n-p non-forced colors are defined so as to modify one or more colors, and the newly-obtained image is then examined on returning to step 10.

It is thus possible to proceed by successive iterations as represented in the diagram of FIG. 2 by dashed line arrow 11.

In the example described, the color original 6 is an RGB encoded image in which the color (including its tone) of each pixel is encoded on 24 bits, and the indexed image-creation function of the above-mentioned "Photoshop" software is used to constitute the composition of the colored unit areas.

This function makes it possible to go form an RGB encoded image in which the color (including its tone) of each pixel is encoded on 24 bits to an indexed image in which the color (including its tone) of each pixel is encoded on a restricted number q of bits relating to reference colors which are themselves (including the tones thereof) encoded on 24 bits.

Originally, such a function was intended to reduce the memory space required in the computer for the images to which it was applied.

With a satisfactory selection of n base colors, the composition of the colored unit areas is separated in step 12 into n one-color images $\mathbf{12}_1, \ldots, \mathbf{12}_n$ that are to be superposed.

Figure 3:
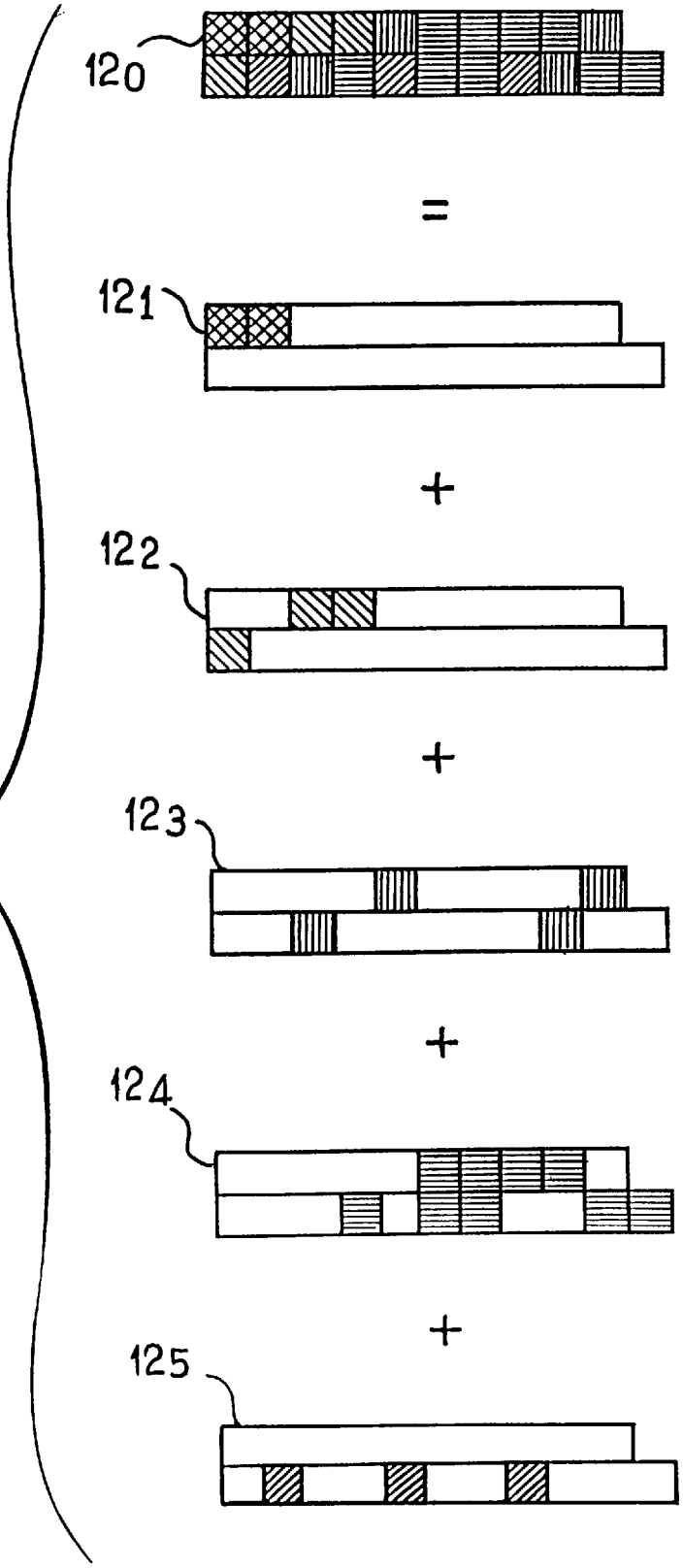
FIG. 3 is a diagram showing how an image made up by a set of juxtaposed pixels is separated into a superposition of one-color images.
Figure 4:
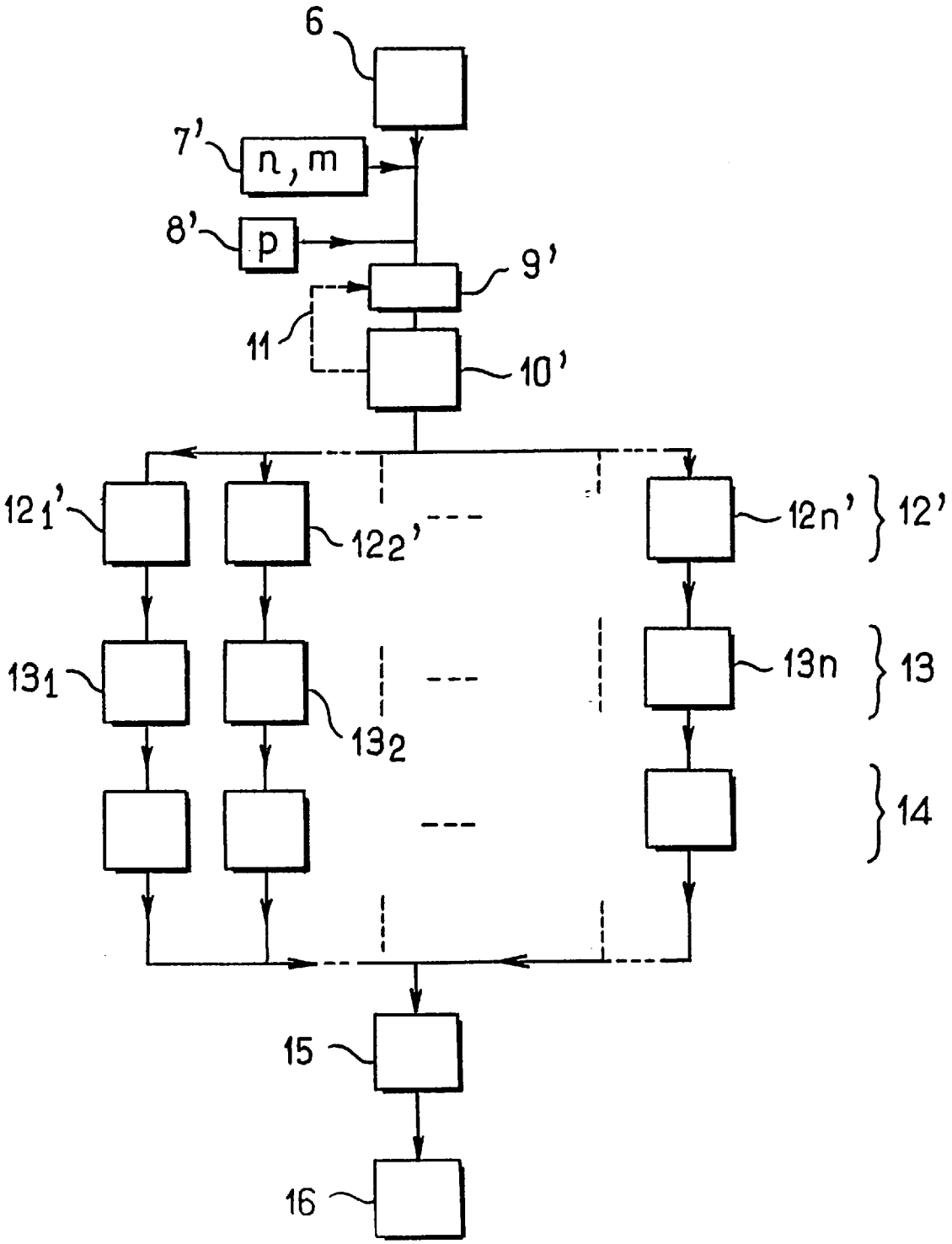
FIG. 4 is a flow chart showing the various steps of an example of the method of the invention.

By way of example, FIG. 3 shows a fragment $\mathbf{12}_0$ constituted by a set of regularly juxtaposed unit areas of constant size in which color is selected from a predetermined number of base colors, which number is equal to 5 in the example under consideration.

Separation provides five one-color images $\mathbf{12}_1$ to $\mathbf{12}_5$ which, on being superposed, reproduce the image $\mathbf{12}_0$.

In following step 13, respective negatives $\mathbf{13}_1$ to $\mathbf{13}_n$ are made from the n one-color images $\mathbf{12}_1$ to $\mathbf{12}_n$, to serve during subsequent step 14 for etching the n plates of the applicator rollers 4.

When the machine 1 is used, the set of applicator rollers 4 operate in step 15 to deposit ink dots of uniform size on each blanket 2. In the present example, the dots are of square shape, they are regularly juxtaposed, and they are distributed as a function of color in a manner that is tied to the way in which the various pixels are distributed in the image as obtained in step 10 of the method.

The dots of ink deposited on each blanket 2 are transferred during step 16 onto the object to be printed.

Figure 12:
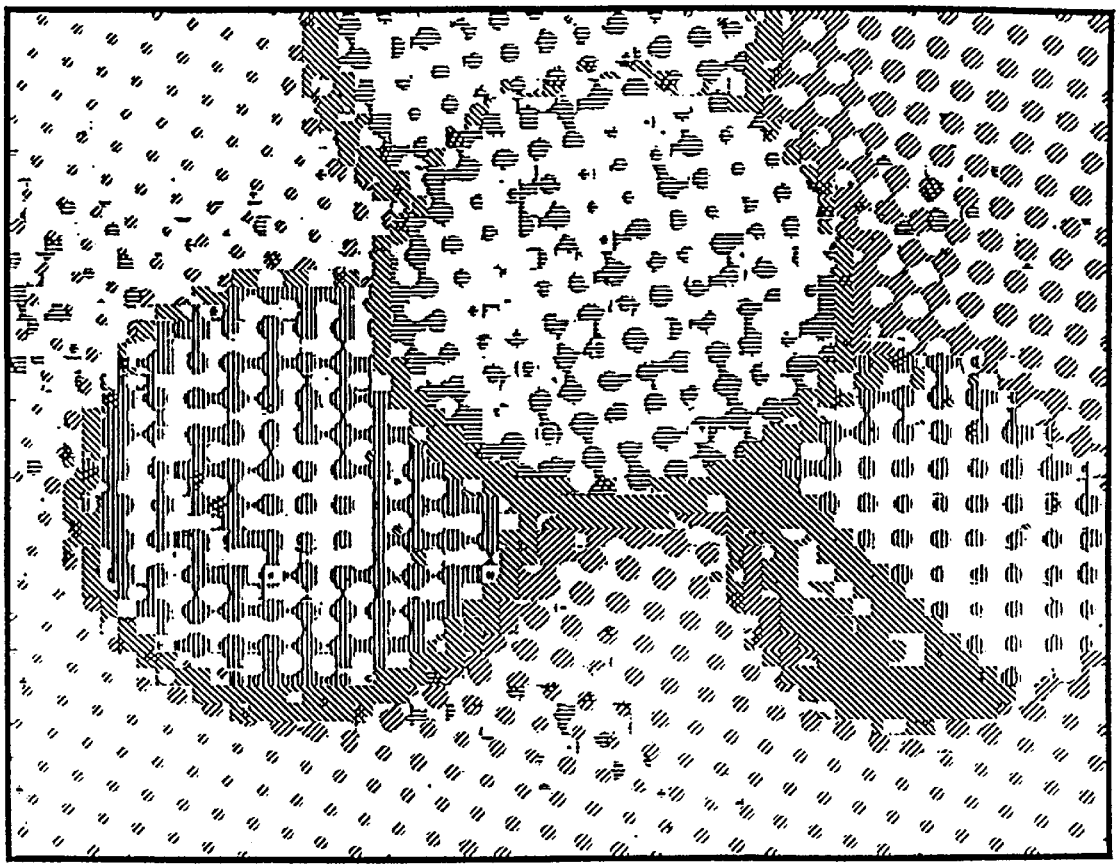
FIG. 12 is a diagrammatic view on an enlarged scale of an image printed using a prior art method.

FIG. 12 shows an image as obtained by a prior art method.

As can be seen on examining this figure, the image is constituted by a superposition of half-tone one-color images with different screen angles, with variations in density in the one-color images being translated into variations in the sizes of the dots constituting the half-tone screen.

Figure 13:
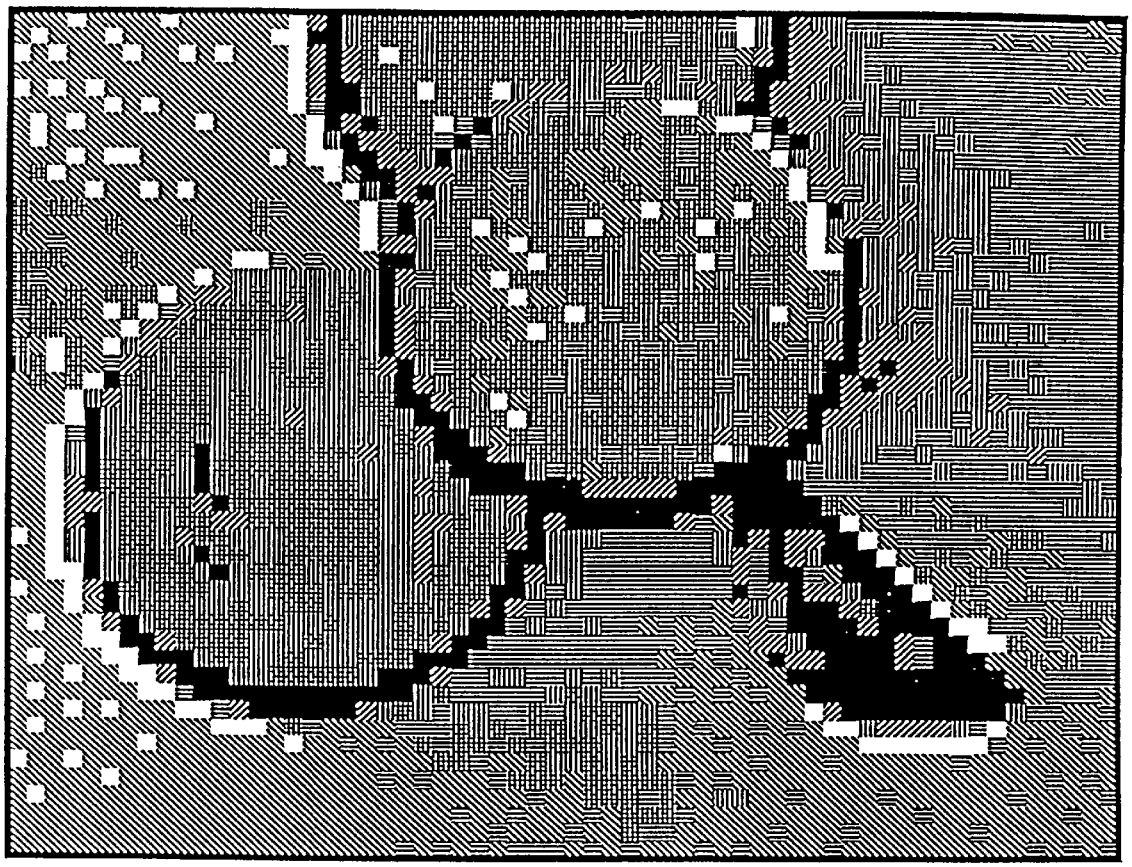
FIG. 13 is a diagrammatic view on an enlarged scale of an image printed using the method as described with reference to FIG. 2.

By way of example, FIG. 13 shows an image obtained by implementing the first example of the method.

This image is constituted by a composition of colored unit areas where the unit areas are regularly-juxtaposed, same-size squares.

In the particular described, the surface of the object on which the image is printed is assumed to be of a uniform white hue and it will be observed in the image shown in FIG. 13 that there are locations where there are no ink dots within said composition of colored unit areas, thus allowing the background color to show through.

Naturally, the background color used may be a color other than white or may be non-uniform and should be taken into consideration when generating the one-color images during step 12 of the method.

The first example of the method as described above considerably reduces the problem of ink pollution during dry offset printing.

Nevertheless, the visual rendition of the printed image is further improved by choosing, for at least one of the base colors, a number of tones that is greater than 2, in accordance with the invention.

In a second example of the method of the invention, as described with reference to FIGS. 4 to 11, the color original 6 is separated into a composition of colored unit areas having hues selected from n base colors and m tones per base color.

In step 7', the number of base colors n and the number of tones m per base color are specified, and in step 8', where appropriate, certain base colors and/or tones are forced.

If the total number of hues in which it is desired to separate the color original 6 is greater than the number p of forced hues, then the remaining n-p hues are selected manually or automatically in step 9', e.g. taking the hues that are statistically in the majority in the color original and that have not already been selected.

In step 10' of the method, a composition of colored unit areas is constituted, said unit areas being disposed in a predetermined distribution, with the color of each unit area being selected from the n base colors and the tones thereof, with the choice of base color and the tone allocated to each of said unit areas being performed in such a manner that said composition of colored unit areas visually reconstitutes the image to be reproduced.

The color original can be separated into n base colors with m tones per base color by using the above-mentioned "Photoshop" software, using its function for converting an RGB encoded image into an indexed image.

In step 10' of the method, the user can view the composition of colored unit areas by means of a video screen connected to the computer.

Figure 9:
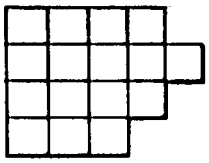
FIGS. 9 to 11 show various distributions of unit areas.

The unit areas are preferably constituted by regularly-juxtaposed squares, as shown in FIG. 9.

Figure 10:
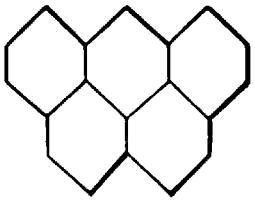
Figure 11:
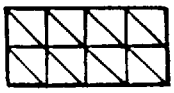

However, it does not go beyond the ambit of the present invention to force other forms of unit areas and other organizations thereof prior to separating the color original, i.e. prior to allocating a hue to each unit area. By way of example, a hexagonal juxtaposition may be selected, as shown in FIG. 10, or a triangular juxtaposition as shown in FIG. 11.

Also without going beyond the ambit of the invention, it is possible to propose a non-regular disposition of unit areas, with varying spacing between them.

Nevertheless, the use of regularly-juxtaposed squares presents the advantage of corresponding to the structure whereby a video screen displays the indexed image in the above-mentioned "Photoshop" software.

As described above, it is possible in step 7' to reconsider the selection of base colors and of tones if the image obtained in step 10' of the method is not satisfactory, e.g. because of the selection of certain forced base colors.

It will be observed that the user can easily perform several trials without it being necessary to proceed with computations for determining the hues that result from subtractive mixing of primary colors, unlike conventional four-color printing.

Thereafter, in step 12' of the method, the composition of the colored unit areas is separated into a set of one-color images.

For each one-color image corresponding to a base color, the tone allocated to each unit area is translated into filling a predetermined proportion thereof with said base color.

Assuming that the tones of a base color are encoded on eight bits, corresponding to 256 possible tones per base color, the binary value 0 means no base color is considered as corresponding to a tone of said base color, and for a given base color each binary value is associated with a respective size and shape for the "dot" so that the "dot" fills a predetermined fraction of the corresponding unit area.

Thus, with a low-saturation tone corresponding to a low binary value, the example described gives rise to a small portion only of the total area of the associated unit area being filled, whereas with a highly saturated tone corresponding to a large binary value, a large portion of the total area of the unit area will be filled.

By allocating a dot size to each non-zero binary value, it is possible to obtain 255 different dot sizes, with the binary value zero being represented by the absence of any dot.

It is also possible, without going beyond the ambit of the invention, to allocate a single dot size to a predetermined range of binary values.

For example, when the binary value representing the tone of the base color under consideration lies between 0 and 100, the tone may be represented by a dot occupying 30% (for example) of the total area of the associated unit area, and when said binary value lies in the range 100 to 200, the tone may be represented by a larger dot occupying 60% (for example) of the unit area, etc.

Figure 5:
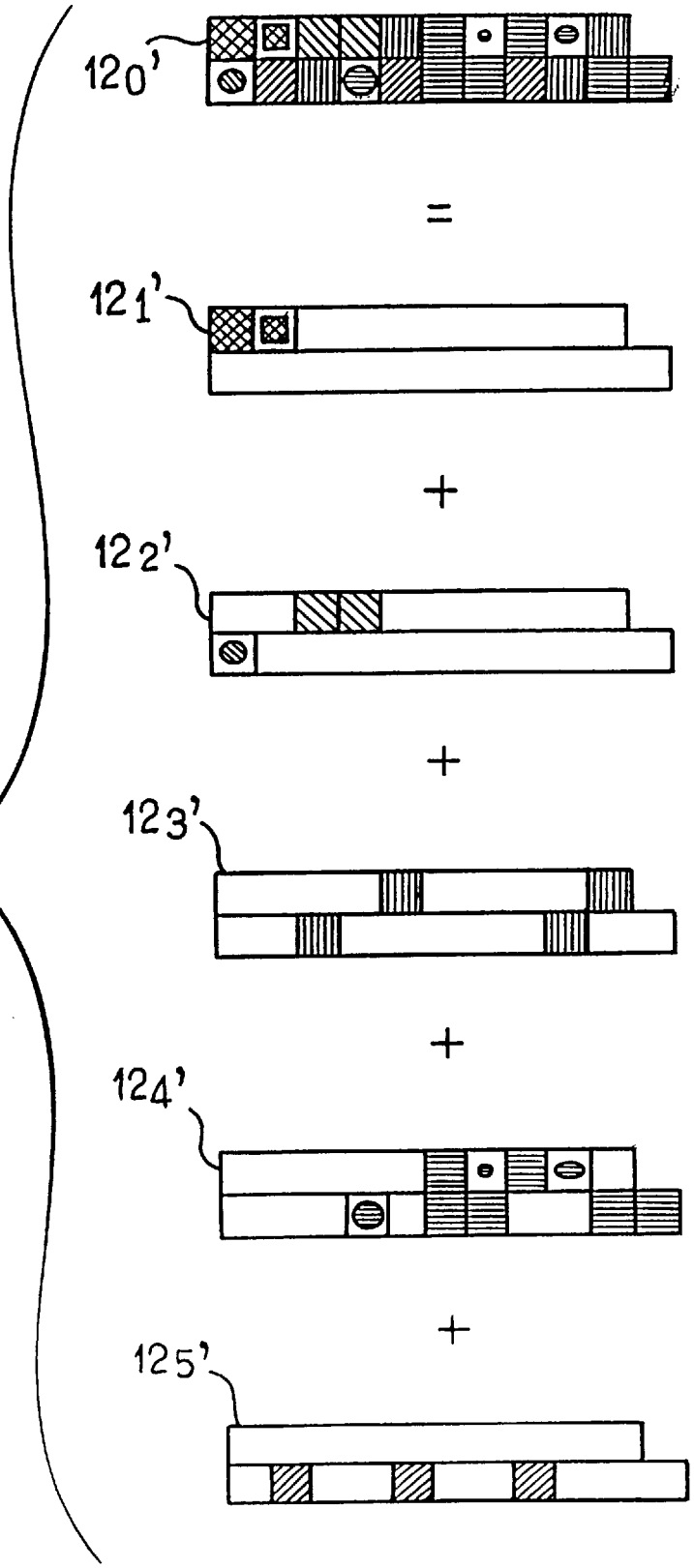
FIG. 5 is a diagram showing how a composition of colored unit areas is separated into a superpositon of one-color images.

By way of example, FIG. 5 shows a fragment $\mathbf{12}_0$' of a composition of colored unit areas, and the rendition of the base colors is illustrated by each unit area being filled to a greater or lesser extent.

This figure also shows how the composition of colored unit areas is separated into one-color images $\mathbf{12}_1$' to $\mathbf{12}_5$'.

The person skilled in the art will observe that the one-color images obtained by separating the indexed image as obtained in step 10' of the method can be just as suitable for rendering details as is said image. Thus, contrast can be localized by the invention on the printed image in a manner that is exactly identical to the indexed image used for producing the one-color images. The invention thus makes it possible to avoid the loss of visible definition encountered in the prior art method due to a difference in resolution between the starting image and the resolution of the screen of the one-color images used for etching the plates on the basis of said starting image.

Once the one-color images have been obtained in which the various tones are represented by dots occupying a fraction of the unit areas that depends on the tone to be reproduced, negatives are produced at step 13, and then the plates are etched at step 14.

Thereafter, dots of ink are deposited on each blanket in step 15 with the dots then being transferred in step 16 onto the object that is to be printed.

To prevent two ink dots associated respectively with two adjacent unit areas and not covering said areas in full touching one another during printing, it is preferable for each ink dot to be centered in the corresponding unit area.

Figure 6:
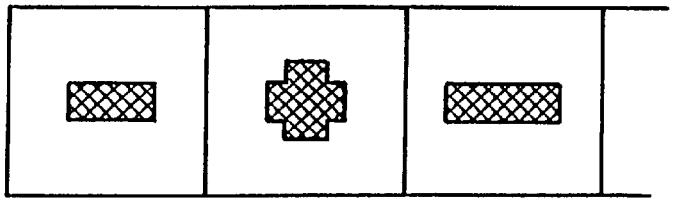
FIG. 6 shows various shapes of ink "dot" deposited within corresponding unit areas.

By way of example, FIG. 6 shows three shapes of ink "dot" that correspond respectively to increasing occupancy of the associated unit area, for the purpose of reproducing three tones of a base color corresponding to increasing binary values representative of a tone that is more and more saturated.

The choice of shape for the ink "dot" that renders a tone by covering a selected proportion of the associated unit area is advantageously performed by taking into account problems that are associated with accretion.

The shapes of the ink "dot" can also be adapted to the nature of each of the inks used.

Preferably, the selected shape for the ink "dot" is elongate in the displacement direction of the medium to be printed while printing is taking place.

Figure 8:
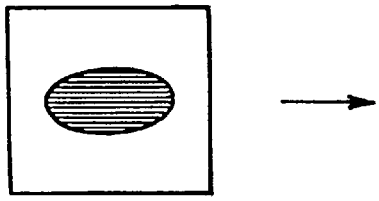
FIG. 8 is an example of a shape of ink "dot" adapted to restricting the phenomenon of accretion during printing.

By way of example, FIG. 8 shows an elongate ink "dot" in the travel direction of the medium to be printed, as represented by an arrow in this figure.

In a particular implementation of the method of the invention, to render a plurality of tones of a base color, the ink "dot" selected are constituted by reproducing a predetermined pattern to a greater or lesser extent.

Figure 7:
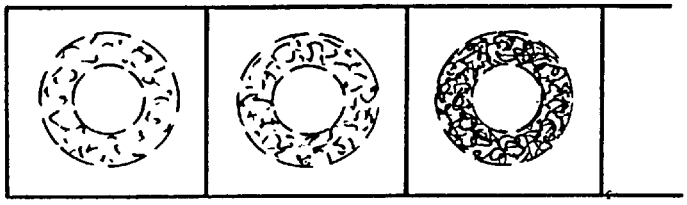
FIG. 7 shows how tone can be rendered by printing a predetermined pattern to a greater or lesser extent.

By way of example, FIG. 7 shows three shapes of ink "dot" corresponding to three different tones of a base color, the ink "dot" corresponding to a predetermined O-shaped pattern being drawn progressively more and more fully, preferably using random filling.

The term "random filling" is used to indicate that the pattern is drawn by elementary dots or lines distributed at random within the outline of the pattern.

Completely filling a pattern inside a unit area corresponds to printing a predetermined tone having a certain degree of saturation.

Since any more-saturated tone corresponds to a greater area being colored within the unit area, this can be done by filling in a given proportion of the area of said unit area that lies outside the outline of the pattern, and preferably in doing so randomly.

Thus, when the tone corresponds to filling a major portion of the associated unit area, the pattern becomes more difficult to make out.

Above a certain degree of filling, it is no longer possible to recognize the pattern.

To render a less-saturated tone corresponding to filling only a small proportion of the unit area, the pattern can be represented in part only.

Beneath a certain fraction of the unit area being filled, it is thus likewise no longer possible to recognize the pattern.

Figure 14:
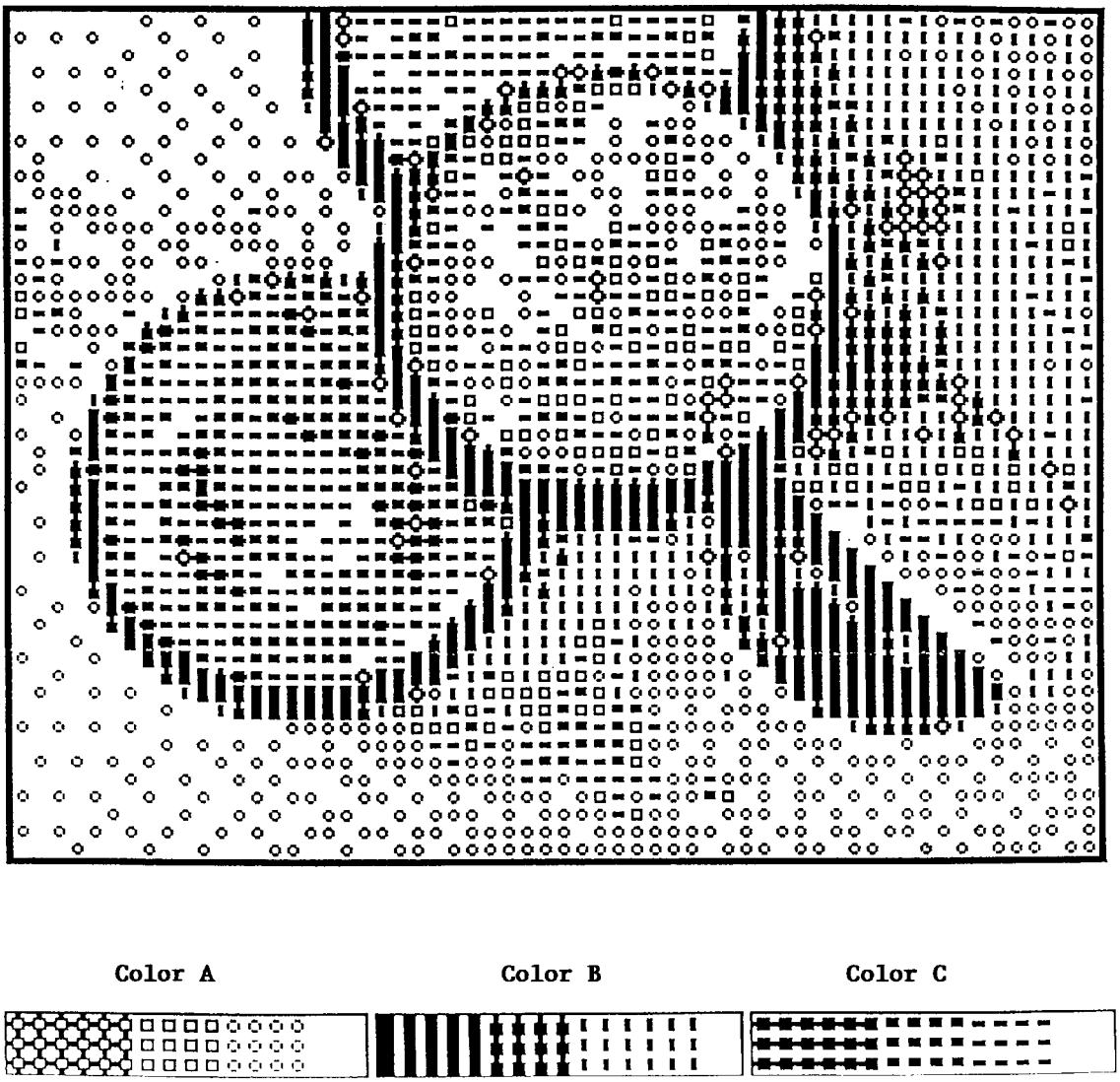
FIG. 14 is a diagrammatic view on an enlarged scale of an image printed using the method of the invention as described with reference to FIG. 4.

FIG. 14 shows a composition of colored unit areas obtained by the method of the invention, said unit areas being constituted by regularly-juxtaposed squares.

Each unit area is either uncolored, in which case it allows the background color to show through, or else it is colored by one of three colors A, B, and C, with tones being represented by respective "dots" of different sizes as shown in the figure.

Figure 15:
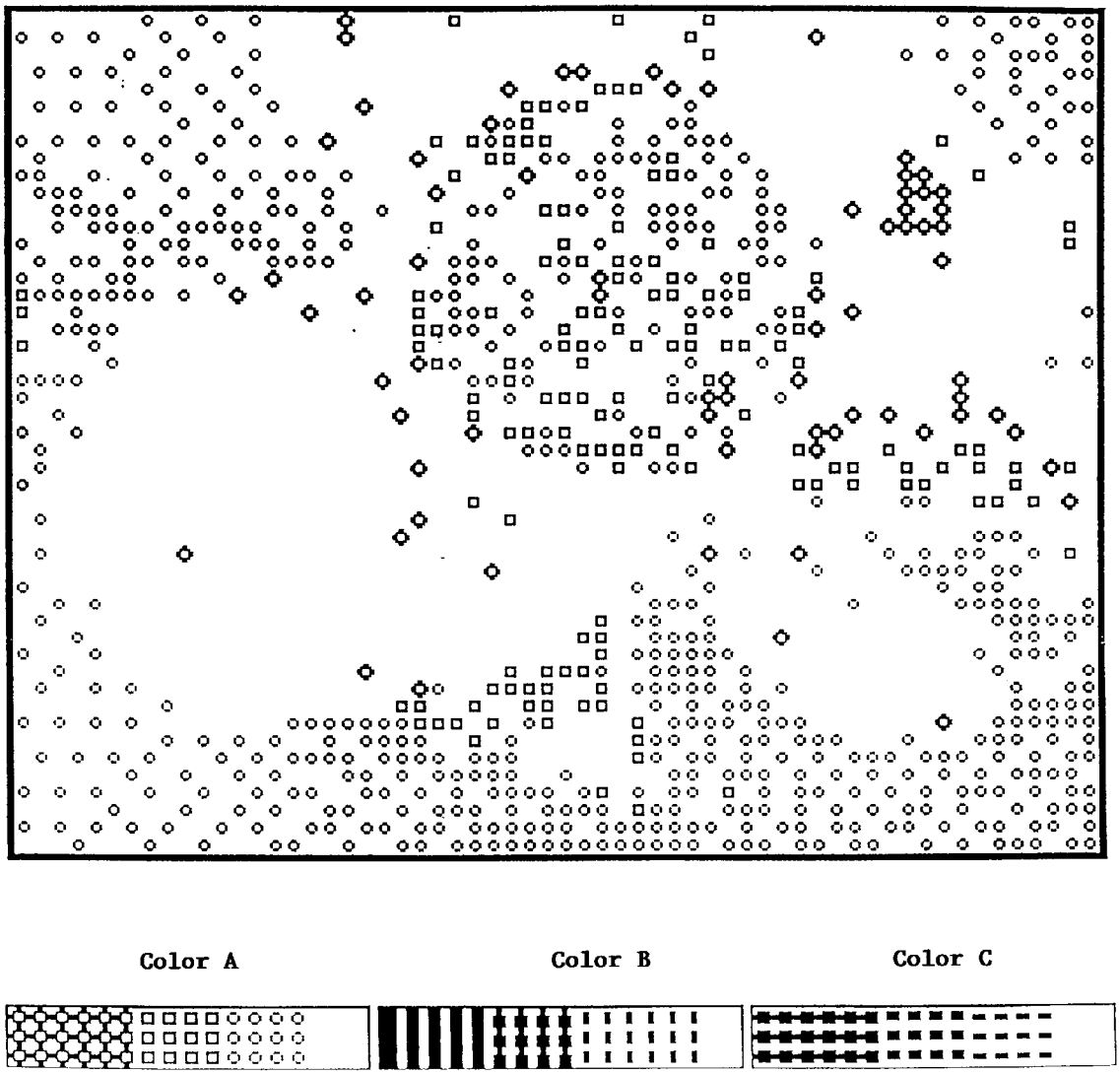
FIGS. 15 to 17 show how the image of FIG. 14 is separated into one-color images.
Figure 16:
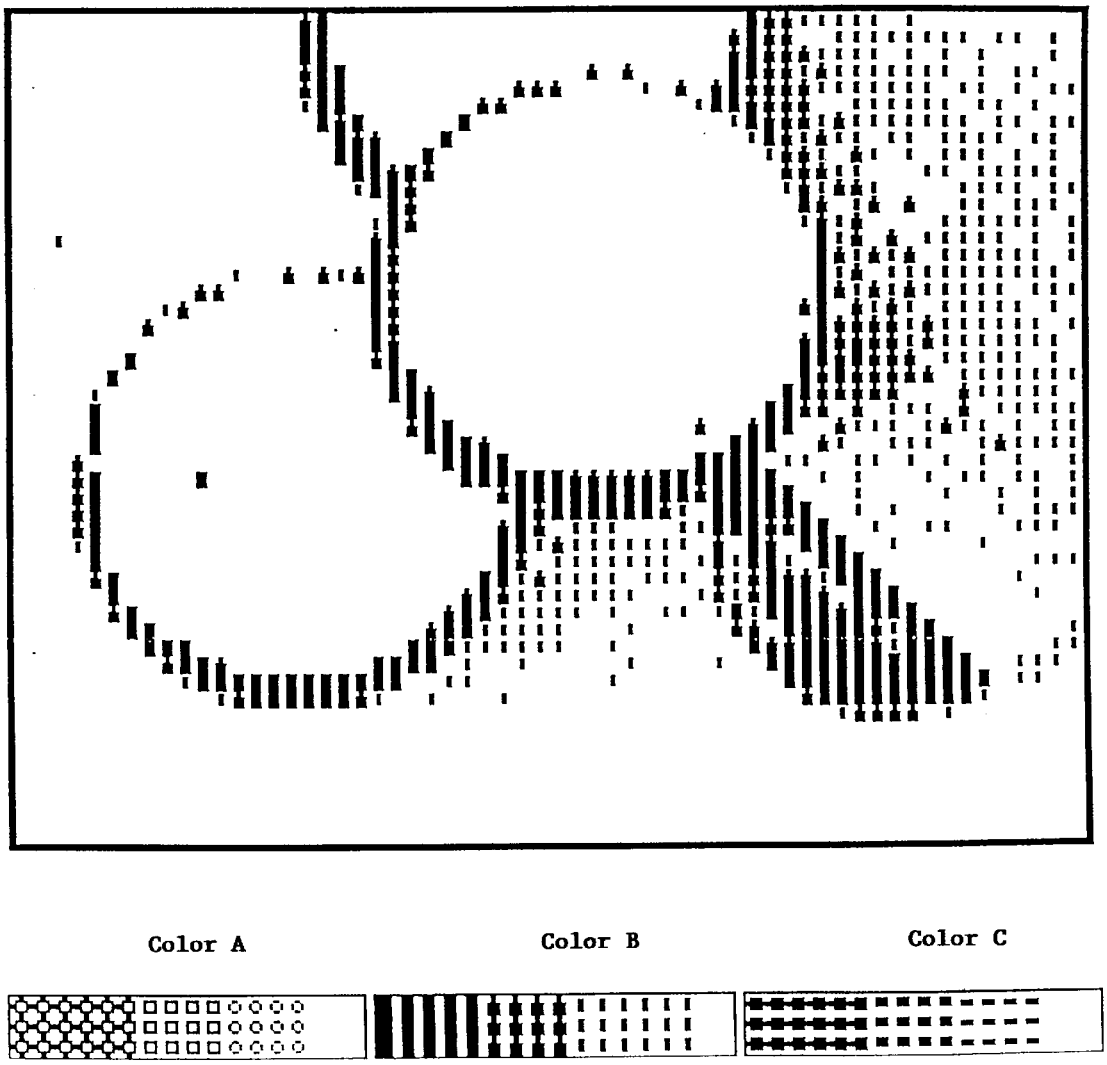
Figure 17:
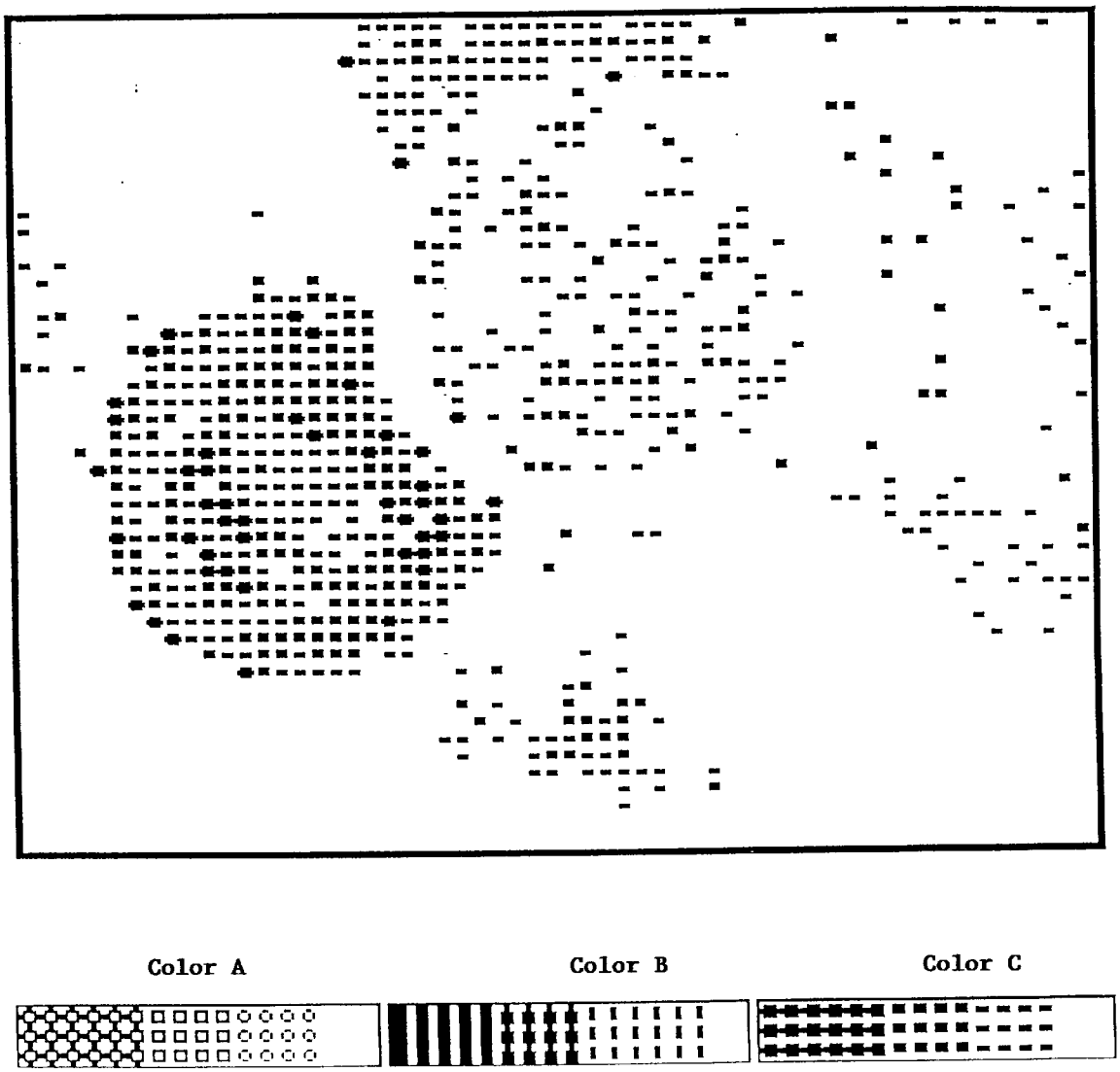

FIGS. 15 to 17 show three one-color images, each obtained by separating the colored unit area composition shown into FIG. 14 into the colors A, B, and C, respectively, which images are used for making the negatives used for printing purposes.

Figure 18:
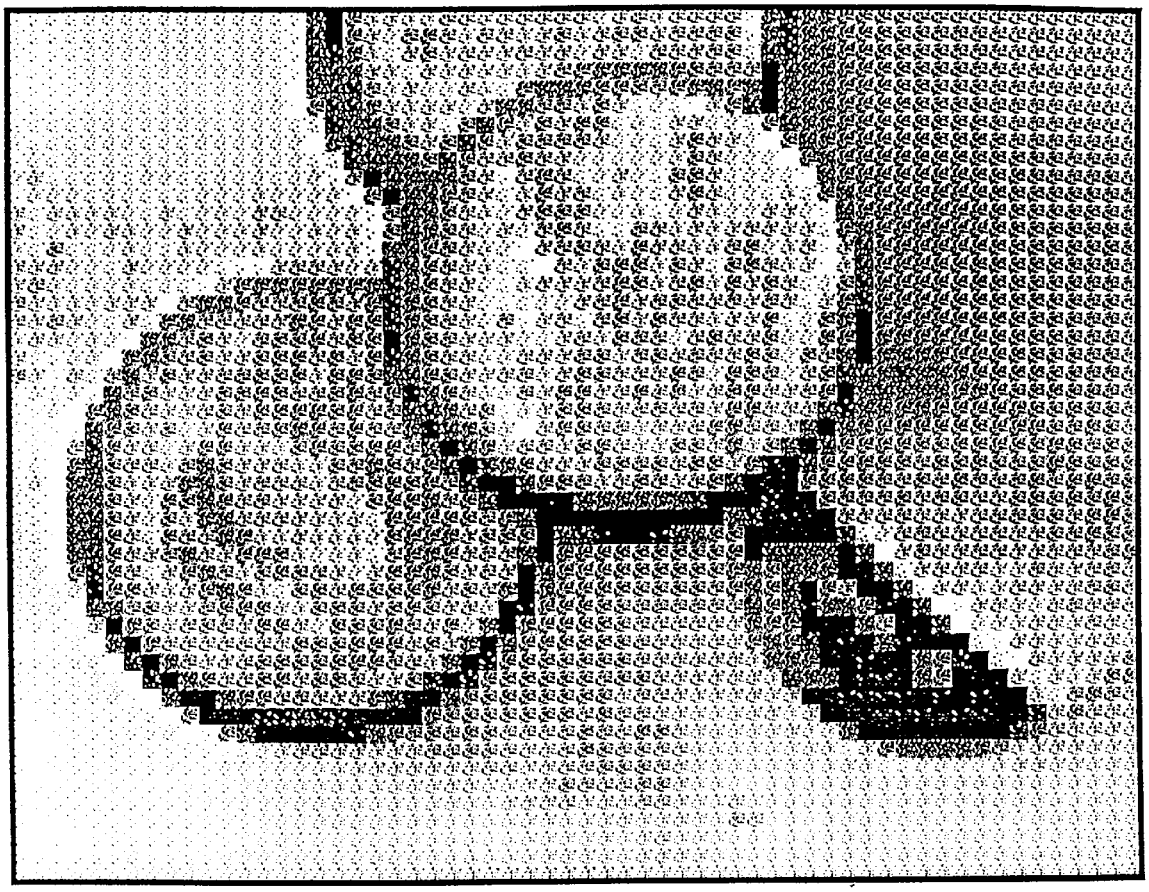
FIG. 18 shows how tones are rendered in a base color by printing a predetermined pattern to a greater or lesser extent.
Figure 18:
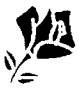

FIG. 18 shows a one-color image in which each ink "dot" disposed within a unit area constituted by a square, is represented by a pattern drawn to a greater or lesser extent depending on the tone to be rendered.

As an indication, when the unit areas are regularly-juxtaposed squares, each square may have a side of 127 $\mu$m on the printed medium, which is equivalent to a resolution of 200 lines per inch (79 lines per cm).

By means of the invention, it is possible to isolate a point occupied, for example, all of the square unit areas having a side of 127 $\mu$m by not filling the adjacent unit areas.

As an indication, in a conventional amplitude-modulated half-tone screen at 133 lines per inch (52 lines per cm), the size of the dots when separated by a distance equal to their diameter is 95 $\mu$m. This dimension is considered as being the dimension for which an isolated dot is most visible, since when the dots are further apart they are smaller and more difficult to see, and when they are larger it is more difficult to distinguish the individual dots.

Thus, in the above example, in spite of the fact that an isolated dot is larger in the invention than is an isolated dot in an amplitude-modulated half-tone screen, the invention makes it possible to have resolution that is greater, which is quite surprising at first glance.

The better resolution provided by the invention can give the observer an impression of the observed image being finer.

Also, when the number of tones is at least three per base color, the dots that completely fill the associated unit areas on the medium are in the minority and if two dots overlap slightly during printing because of the accretion phenomenon, that can be accepted without worrying about a serious problem of ink pollution during printing as happens in dry offset printing.

Another example of the method of the invention is described below with reference to FIGS. 19 to 24.

In general, a color can be defined by its hue, by its lightness, and by its saturation.

Figure 19:
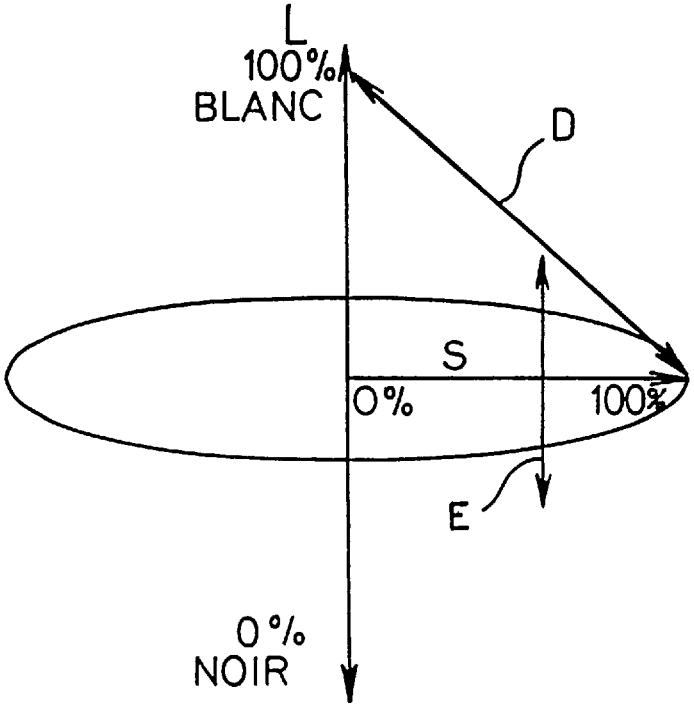
FIG. 19 is a diagrammatic representation of color base.

FIG. 19 shows an example of color space.

It is conventional to plot the lightness L of a color by its projection on an axis, the hue of the color by its angular position about said axis, and the saturation S of the color by its distance from the axis.

Thus, colors located in this space on a common circle centered on the axis L have different hues but identical lightness and saturation.

In the implementation of the invention as described above, the tones of a given base color are obtained by filling a unit area to a greater or lesser extent, which can be represented generally in FIG. 19 by moving along a line D.

By reducing the fraction of the unit area that is colored, lightness is increased while saturation is decreased, and by increasing the fraction of the unit area that is colored, lightness is decreased and maximum saturation is approached (assuming that the background is uniform white).

The example of the method of the invention described below seeks to further extend the number of tones that can be used to reproduce the color original by varying the lightness parameter in a downwards direction, i.e. in the E direction in FIG. 19, starting from a tone corresponding to given degrees of lightness and of saturation.

For this purpose, black ink is deposited over a greater or lesser fraction within the unit area which is otherwise colored to a selected extent depending on the saturation of the tone to be reproduced.

Figure 20:
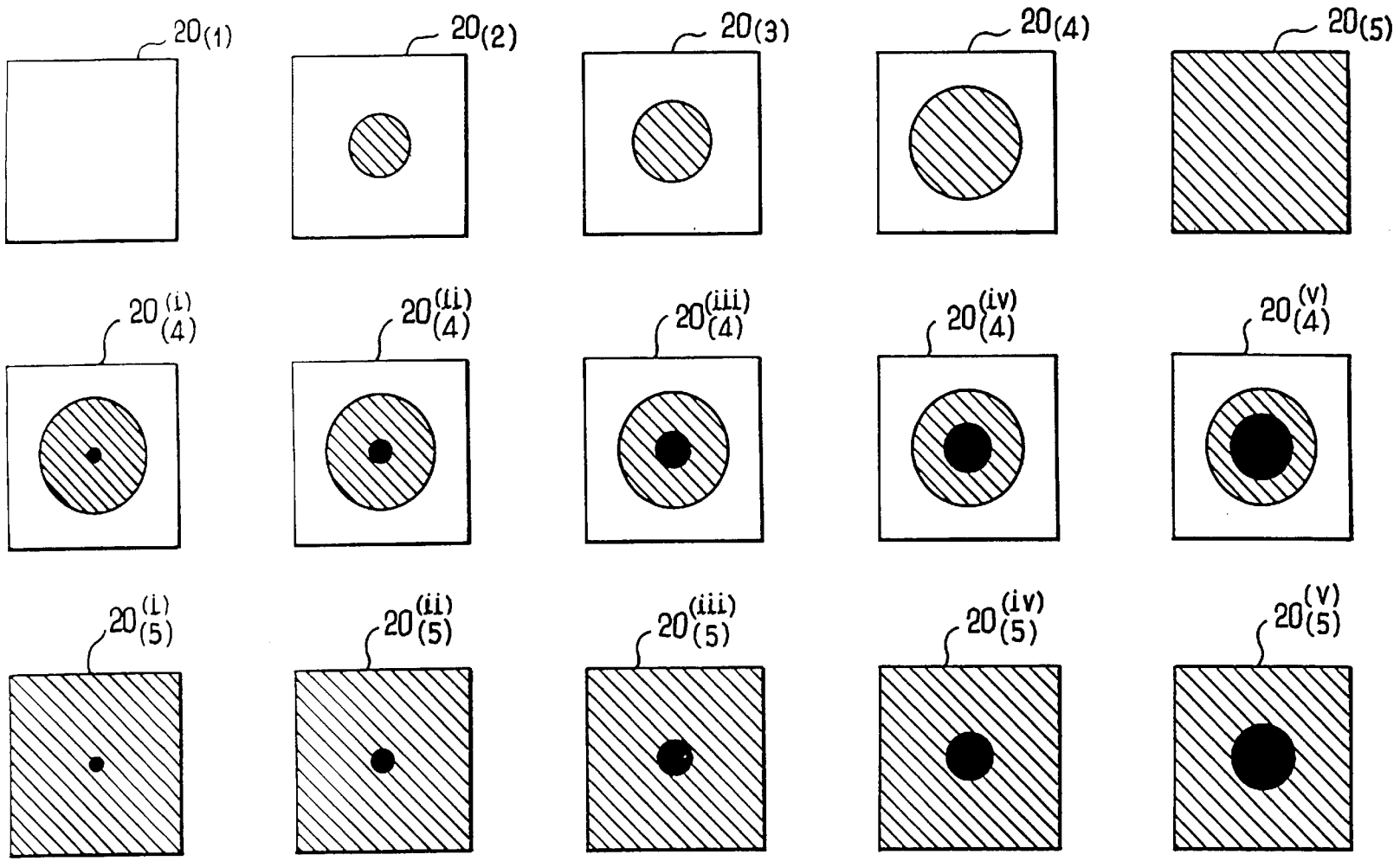
FIG. 20 shows how various tones of a given base color are rendered during printing by means of another example of the method of the invention.

FIG. 20 shows a first row of five unit areas $\mathbf{20}_{(1)}$ to $\mathbf{20}_{(5)}$ which are colored to an increasing extent with a given ink.

The area of $\mathbf{20}_{(1)}$ is not colored at all and the area of $\mathbf{20}_{(5)}$ is fully colored.

The areas of $\mathbf{20}_{(4)}$ and of $\mathbf{20}_{(5)}$ each corresponding to given degrees of lightness and of saturation are used as bases for generating second and third families of tones respectively referenced $\mathbf{20}_{(4)}^{(i)}$ to $\mathbf{20}_{(4)}^{(v)}$ and $\mathbf{20}_{(5)}^{(i)}$ to $\mathbf{20}_{(5)}^{(v)}$ by adding progressively increasing amounts of black.

It will thus be understood that using black ink makes it possible to increase the number of tones that can be used for separating the color original since it makes it possible to render variations in lightness at substantially constant saturation.

Thus, certain tones are rendered for each base color by using black ink during printing, with black ink being deposited on some of the unit areas of the medium.

Figure 21:
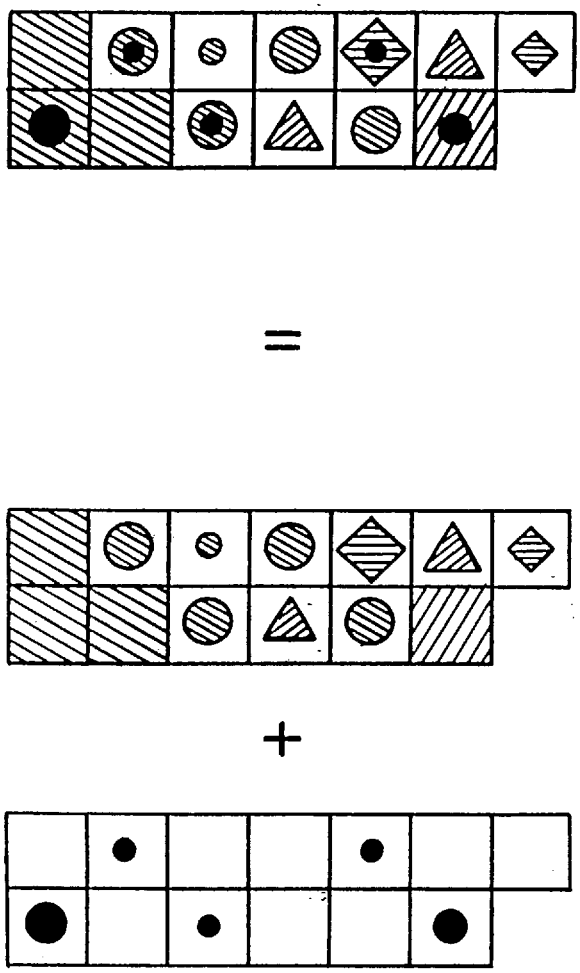
FIG. 21 shows how tones of various base colors are obtained during printing by depositing black ink in accordance with the example of the method of the invention as described with reference to FIG. 20.

Black ink can be applied in a single operation after all of the other inks have been applied, as shown in FIG. 21.

The top of the figure shows a fragment of a medium which has been printed by depositing various different colored inks within the unit areas, each filling the corresponding unit area to a greater or lesser extent depending on the saturation of the tone to be rendered.

To obtain certain tones, black ink has also been deposited.

The black ink can be deposited after the other colors that are used have been deposited.

Figure 22:
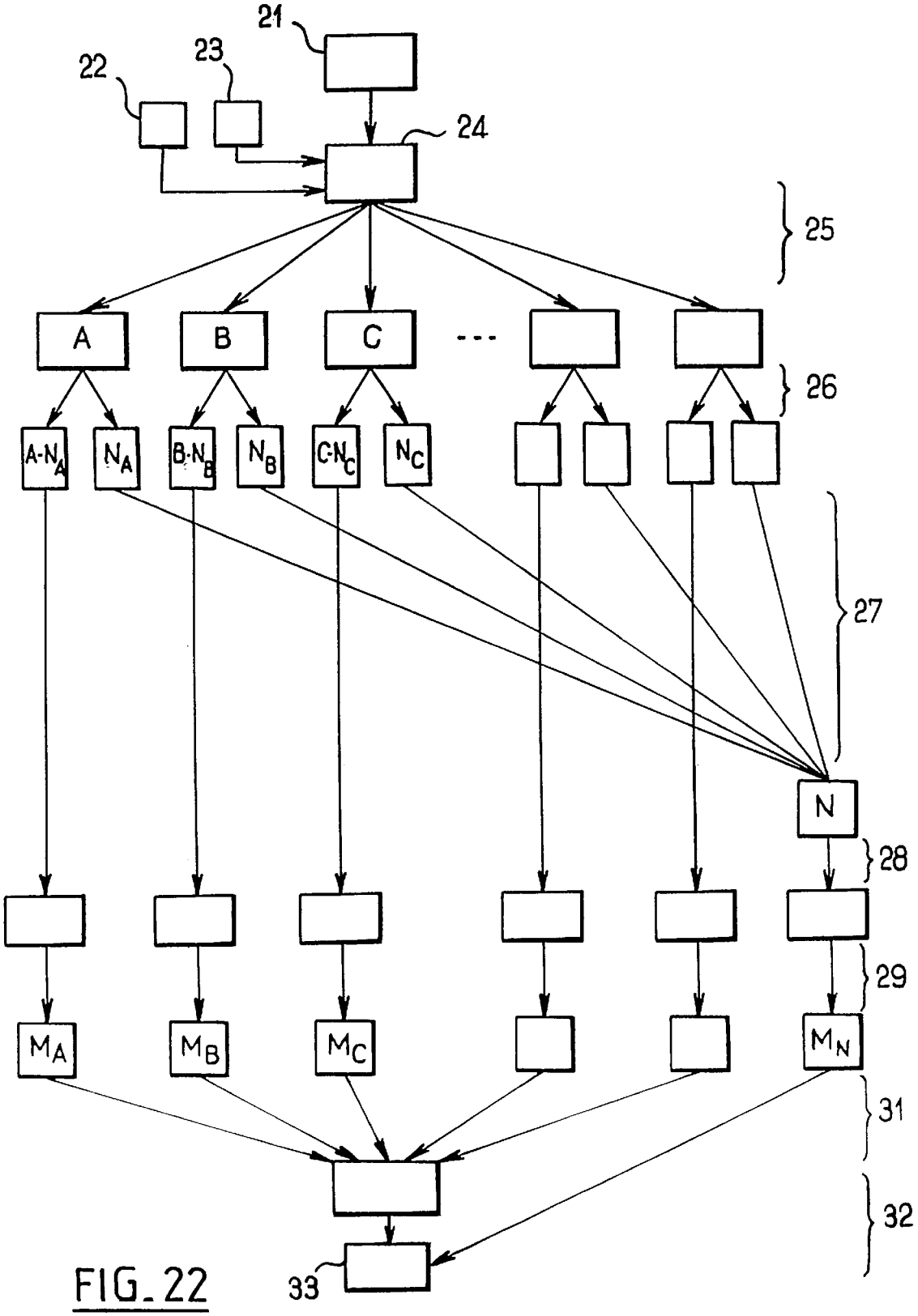
FIG. 22 is a flow chart showing the various steps in the method of the invention as described with reference to FIGS. 20 and 21.

The various steps of the method are described below in detail with reference to FIG. 22.

Initially, the image to be reproduced is acquired in the form of a digital data file 21, e.g. an RGB encoded file.

The distribution of unit areas is selected at 22, e.g. one of the distributions shown in FIGS. 9 to 11, and the set of base colors and of tones for said base colors into which the original for reproduction is to be separated are selected at 23.

An indexed image is then created in step 24, corresponding to the above-defined unit areas being colored by the colors and the tones of the set 23, with the composition of colored unit areas as obtained in this way visually rendering the image to be reproduced.

Thereafter, in step 25, the indexed image obtained in step 24 is separated into a plurality of one-color images, each corresponding to a given base color A, B, C, etc. . . .

Thereafter, in step 26, the one-color images A, B, C, . . . , are separated into respective images A-$N_A$, B-$N_B$, C-$N_C$, . . . combining the tones that do not require black and into respective images $N_A$, $N_B$, $N_C$, . . . that require black only.

In step 27, the various images $N_A$, $N_B$, $N_C$, . . . are superposed to obtain a black and white one-color image N.

For the plurality of one-color images A-$N_A$, B-$N_B$, C-$N_C$, . . . , and N, step 28 consists in determining for each tone the size of the ink dot to be deposited on the medium to render said tone, and in step 29, each dot size is given a pattern that occupies the unit area of the medium to the desired extent.

A plurality of one-color images $M_A$, $M_B$, $M_C$, . . . and $M_N$ is obtained in which the tones are rendered by the presence within each unit area of an ink dot of predetermined shape and size, and where appropriate negatives are made from the one-color images in order to provide print rollers.

In step 31, printing is performed on the medium using the various base colors other than black.

Black ink is printed during step 32, thus obtaining a reproduction 33 of the original image.

Figure 23:
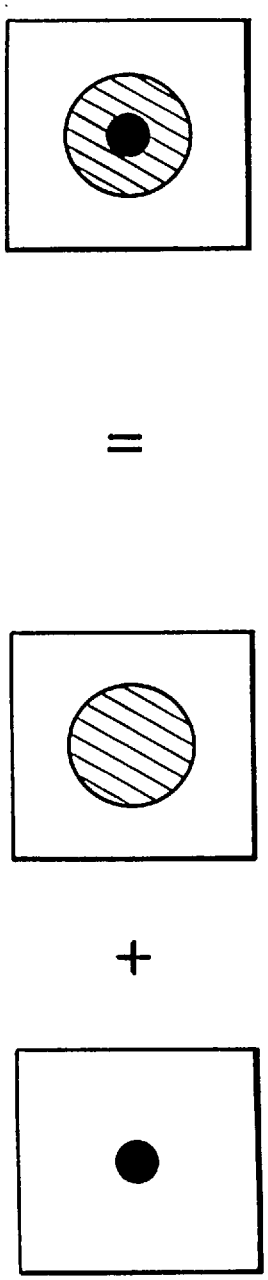
FIGS. 23 and 24 show two ways in which black ink can be deposited within a unit area on the medium.

When the printing method used is not a dry offset printing method, it is possible to deposit black ink directly on the ink previously printed on the medium, as shown in FIG. 23.

When the printing method is a dry offset printing method, in order to avoid superposing inks and the problems of inks mixing, it is possible when determining the shape of the ink dots that are to be deposited on the medium for rendering a tone of given color, to take into account the shape and the size of the black ink dot that will subsequently be deposited for the purpose of changing the lightness of the tone under consideration.

Figure 24:
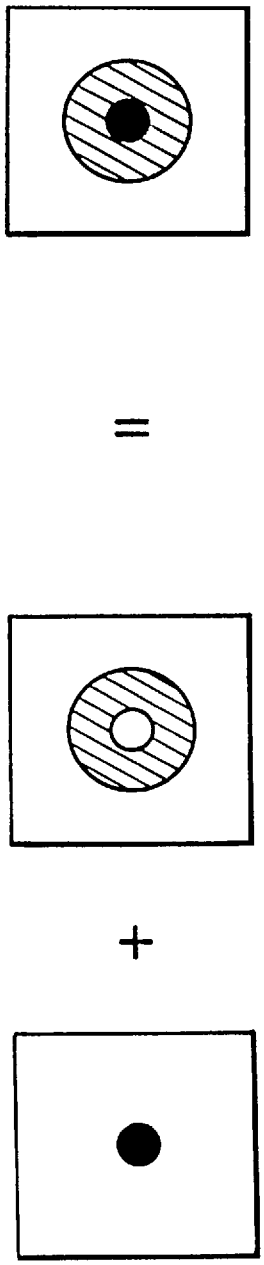

More particularly, it is possible to avoid depositing color ink in the region of the unit area that is subsequently to be covered in black ink, as shown in FIG. 24.

The invention is not limited to the three examples of methods described above.

The invention thus applies advantageously to methods of printing other than dry offset printing, e.g. silkscreen printing, sublimation, etc., in which the shapes of the printed dots can be adapted to each method of printing so as to compensate for the defects thereof.

From the structure of the final image on the printed medium, the invention is particularly well adapted to printing images that are encoded in digital form.

The person skilled in the art will understand that the invention can make it possible to benefit from that advantages specific to conventional screens known as amplitude-modulated and frequency-modulated screens, namely both sharpness of the printed image (by contrast being localized in a manner that is identical to the starting image) and by the impression of softness (due to the constant spacing of the screen dots), without the drawbacks of conventional screens, namely a noise effect for a frequency-modulated screen and a fuzzy effect for an amplitude-modulated screen.

I claim:

1. A method of printing a color image on a medium, the method comprising the following steps:

separating the image to be reproduced into a composition of colored unit areas, said unit areas being disposed in a predetermined distribution, the color of each unit area being selected from a predetermined set of base colors and a predetermined set of tones of said base colors, at least one of said base colors is a non-primary color other than black, the number of tones for at least one of the base colors being greater than or equal to three, the base color and the tone allocated to each of said unit areas being selected so that said composition of colored unit areas visually reconstitutes the image to be reproduced; and printing said composition of colored unit areas on said medium by means of inks whose hues are selected, taking into account the color of said medium, so as to be capable of reproducing said base colors and the tones thereof during printing, the tone of a base color allocated to a given unit area being obtained during printing by acting on the proportion of each ink within the corresponding unit area on the medium.

2. A method according to claim 1, wherein the tones of at least one base color have the same saturation but different lightnesses.

3. A method according to claim 2, wherein the tones of a base color having the same saturation but different lightnesses are rendered during printing by a greater or lesser proportion of black ink within the unit areas of the medium that are concerned for obtaining said tones during printing.

4. A method according to claim 3, wherein, when a single unit area of the medium is concerned both by depositing black ink and by depositing an ink other than black ink, the black ink and the said ink other than black ink are deposited with predetermined patterns for each of the inks, which patterns are selected so as to avoid superposing the two inks.

5. A method according to claim 3, wherein black ink is deposited so as to be superposed on at least one other ink already deposited on the medium.

6. A method according to claim 1, applied to dry offset printing.

7. A method according to claim 1, wherein said base colors are non-primary colors.

8. A method according to claim 1, wherein at least all of the inks minus one are of hues selected from said base colors.

9. A method according to claim 1, wherein said unit areas are of the same shape.

10. A method according to claim 9, wherein said unit areas are all derived from one another by translation.

11. A method according to claim 1, wherein said unit areas are juxtaposed.

12. A method according to claim 1, wherein said unit areas are square.

13. A method according to claim 1, wherein each ink dot is centered in the corresponding unit area.

14. A method according to claim 1, wherein an ink dot is printed in each unit area on the medium, with the shape and the size of the dot depending in a predetermined relationship on the tone of the base color to be reproduced.

15. A method according to claim 14, in which printing is performed by bringing the medium to be printed into contact with an ink-filled surface with a displacement direction that is substantially tangential to said ink-filled surface, wherein said ink dots, when they do not fill the entire extent of the associated unit area, are of a shape that is adapted to reducing the phenomenon of accretion.

16. A method according to claim 1, wherein a tone of at least one of the base colors is obtained on printing, by printing a predetermined pattern.

17. A method according to claim 16, wherein a plurality of tones of at least one of the base colors is obtained by printing a predetermined pattern such as a logo in a greater or lesser proportion.

18. A method according to claim 1, wherein the inks are deposited in the form of ink "dots" of shapes that differ depending on the ink used.

19. A method according to claim 1, wherein, prior to printing, said medium is white.

20. A method according to claim 14, wherein said ink dots are of a shape that is substantially slender and elongated in the displacement direction of the medium.

21. A method of printing a color image according to claim 1, wherein said predetermined set of base colors and predetermined set of tones of said base colors are not superimposed during printing.

22. A printing machine including ink application surfaces respectively inked by ink dots respectively situated within unit area disposed in a predetermined distribution so as to reconstitute visually, when printing on a medium, an image that is to be reproduced, the color of each ink dot being selected from a predetermined set of base colors, at least one of said base colors is a non-primary color other than black, each given unit area being covered in ink to a proportion that is selected as a function of the tone to be reproduced, the number of tones being at least three for at least one of the base colors.

23. A printing machine according to claim 22, wherein the colors of the ink dots are non-primary.

24. A dry offset printing machine including at least one blanket and applicator rollers carrying relief disposed in such a manner as to deposit on said blanket a set of ink dots situated respectively within unit areas disposed in a predetermined distribution so as to reconstitute visually, on printing on a medium, an image that is to be reproduced, the color of each ink dot being selected from a predetermined set of base colors, at least one of said base colors is a non-primary color other than black, each given unit area being covered in ink to a proportion that is selected as a function of the tone to be reproduced, the number of tones being at least three for at least one of the base colors.

25. A dry offset printing machine according to claim 24, wherein each element of relief is designed to deposit ink within a unit area to reproduce a tone is substantially tapering and elongate in shape in the displacement direction of the medium to be printed.

26. A dry offset printing machine according to claim 24, wherein the color of each ink is non-primary.

27. A print medium having an outside surface on which an image has been printed that is constituted by a set of ink dots each respectively situated within a unit area disposed in a predetermined distribution, the colors of said ink dots being selected from a predetermined set of base colors, at least one of said base colors is a non-primary color other than black, each ink dot of a given base color filling the corresponding unit area to a greater or lesser proportion, depending on the tone of the base color to be reproduced, the number of tones being at least three, for at least one of the base colors.

28. A print medium according to claim 27, wherein said unit areas are of the same shape.

29. A print medium according to claim 27, wherein said unit areas are juxtaposed.

30. A print medium according to claim 27, wherein each unit area is constituted by a square.

31. A print medium according to claim 27, in which said outside surface is cylindrical, wherein said ink dots that do not completely fill the corresponding unit areas are tapering and substantially elongate in shape in the displacement direction of the medium during printing.

3. A print medium according to claim 27, wherein each ink dot is centered within the corresponding unit area.

33. A print medium according to claim 27, wherein a plurality of tones of at least one base color are rendered by printing a predetermined pattern such as a logo in a greater or a lesser proportion.

34. A print medium according to claim 27, wherein at least one unit area has received a dot of black ink and a dot of ink other than black, the size of the black ink dot being a function of the lightness of the tone to be reproduced.

35. A print medium according to claim 27, wherein all base colors are non-primary.

* * * * *